US008267394B2

(12) United States Patent
Higaki et al.

(10) Patent No.: US 8,267,394 B2
(45) Date of Patent: Sep. 18, 2012

(54) SHEET FEEDING DEVICE AND IMAGE FORMING APPARATUS INCORPORATING SAME

(75) Inventors: Hideto Higaki, Kanagawa (JP); Manabu Nonaka, Kanagawa (JP); Yoshikuni Ishikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/137,400

(22) Filed: Aug. 11, 2011

(65) Prior Publication Data

US 2012/0061904 A1 Mar. 15, 2012

(30) Foreign Application Priority Data

Sep. 9, 2010 (JP) ..... 2010-201610

(51) Int. Cl.
*B65H 3/16* (2006.01)

(52) U.S. Cl. ..... 271/18.2; 271/18.1; 271/34

(58) Field of Classification Search ..... 271/18.1, 271/18.2, 34, 94, 95, 10.06
See application file for complete search history.

(56) References Cited

U.S. PATENT DOCUMENTS

| | | | | |
|---|---|---|---|---|
| 8,157,257 | B2 * | 4/2012 | Toyooka et al. | 271/18.1 |
| 2011/0062651 | A1 * | 3/2011 | Higaki et al. | 271/18.1 |
| 2011/0204557 | A1 * | 8/2011 | Ishikawa et al. | 271/18.1 |
| 2011/0204558 | A1 * | 8/2011 | Takahashi et al. | 271/18.1 |
| 2011/0227275 | A1 * | 9/2011 | Poh et al. | 271/18.1 |
| 2012/0061903 | A1 * | 3/2012 | Eguchi et al. | 271/18.1 |

FOREIGN PATENT DOCUMENTS

| | | | |
|---|---|---|---|
| JP | 3159727 | A | 2/2001 |
| JP | 2003237962 | A | 8/2003 |
| JP | 2003237969 | A | 8/2003 |

OTHER PUBLICATIONS

Abstract of Japanese Patent Publication No. JP04-251041.

* cited by examiner

*Primary Examiner* — Jeremy R Severson
(74) *Attorney, Agent, or Firm* — Harness, Dickey & Pierce, P.L.C.

(57) ABSTRACT

A sheet feeding device that can be incorporated in an image forming apparatus includes a sheet feeder including a belt unit including an attraction belt facing a sheet stack and first and second tension rollers to keep the attraction belt taut, and a side holder to rotatably support the belt unit about the first tension roller that serves as a pivot of the sheet feeder being disposed upstream from the second tension roller in the sheet conveyance direction, a contact and separation drive unit to swing the sheet feeder to make the attraction belt contact with and separate from the sheet stack, and a swing range adjuster to adjust a range of swing of the belt unit with respect to the side holder between contact and separation of the attraction belt with respect to the sheet stack, according to a predetermined condition.

9 Claims, 9 Drawing Sheets

SHEET FEEDING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-201610, filed on Sep. 9, 2010 in the Japan Patent Office, the entire disclosure of which is hereby incorporated herein by reference.

FIELD OF THE INVENTION

Embodiments of the present patent application relate to a sheet feeding device and an image forming apparatus incorporating the sheet feeding device.

BACKGROUND OF THE INVENTION

As a method of separating and conveying stacked sheets, such as documents and recording sheets, a separating and conveying method using frictional force has been used.

The separating and conveying method using frictional force typically uses, for example, a rubber feeding roller, and as a result the frictional force changes over time due to abrasion and other factors, such that the conveying performance is degraded. Further, when sheets of non-uniform (i.e., varying) coefficient of friction or sheets having different coefficients of friction are separated and conveyed in the same separating and conveying operation, a feeding failure occurs in some cases, which includes simultaneous multiple feeding of a plurality of sheets and a failure to separate sheets. Further, in some cases, the sheets are sullied due to a configuration that separates the sheets by applying pressure thereto in the sheet conveying operation.

In view of the above, an electrostatic method as one type of non-frictional separation method has been proposed, which generates an electrical field in a dielectric belt and brings the dielectric belt into contact with a sheet to simultaneously attract the sheet and separate the sheet from other sheets. Such a technique is disclosed, for example, in Japanese Patent Application Publication No. JP-2003-237969-A1.

FIGS. 1A to 1C illustrate a background example of a sheet conveying device 220 according to JP-2003-237969-A1. FIG. 1A illustrates a standby state of the sheet conveying device 220. FIG. 1B illustrates a state in which a sheet is attracted to an attraction belt. FIG. 1C illustrates a state in which the sheet is conveyed.

The sheet conveying device 220 according to JP-2003-237969-A1 as illustrated in FIGS. 1A to 1C includes an attraction separation unit 201 to separate and convey an uppermost sheet S1 of a sheet stack S. The attraction separation unit 201 includes an attraction belt 200 that is stretched taut by a driven roller 202, a drive roller 203, and a tension roller 204. Further, the attraction separation unit 201 includes a charge roller 205 that serves as a charging device that charges a surface of the attraction belt 200, and a roller 206 that contacts the uppermost sheet S1 and rotates together with the uppermost sheet S1.

The drive roller 203, the driven roller 202, the tension roller 204, the charge roller 205, and the roller 206 are rotatably supported by a side plate of the attraction separation unit 201. The side plate is configured to be rotatable around a rotary shaft of the drive roller 203 that serves as an upstream extension roller in a sheet conveyance direction.

In conveyance of the uppermost sheet S1 of the sheet stack S stacked on a bottom plate 211 of a sheet container 210, the bottom plate 211 is lifted to bring the uppermost sheet S1 into contact with the roller 206. Then, the attraction belt 200 is rotated, and an alternating charge is applied to the surface thereof by the charging roller 205. Then, the attraction separation unit 201 is rotated in the counterclockwise direction in FIGS. 1A to 1C around the rotary shaft of the drive roller 203, so that an area of the attraction belt 200 located between and stretched by the driven roller 202 and the tension roller 204 (i.e., a sheet attraction surface) is brought into contact with the uppermost sheet S1 to electrostatically attract the uppermost sheet S1 to the attraction belt 200 (see FIG. 1B). Then, the attraction separation unit 201 is rotated in the clockwise direction to cause a sheet electrostatically attracted to the attraction belt 200 to move together with the attraction belt 200. In this state, the uppermost sheet S1 is wrapped around a portion of the attraction belt 200 in contact with the roller 206 as a fulcrum, and a restorative force acts on the sheet. The attractive force of the uppermost sheet S1 toward the attraction belt 200 is stronger than the restorative force of the uppermost sheet S1, and thus the uppermost sheet S1 moves together with the attraction belt 200.

By contrast, the distance between the subsequent sheet (i.e., the second sheet in the sheet stack S) and the attraction belt 200 is greater than the distance between the uppermost sheet S1 and the attraction belt 200 and the attractive force of the subsequent sheet toward the attraction belt 200 is weaker than the restorative force of the subsequent sheet, and therefore the subsequent sheet separates from the attraction belt 200 (see FIG. 1C). Then, the attraction belt 200 is rotated to convey only the uppermost sheet S1 attracted thereto toward a pair of conveying rollers.

In the sheet conveying device 220 disclosed in JP-2003-237969-A1, the center of swing of the attraction separation unit 201 is set to a position upstream in the sheet conveyance direction of the area of the attraction belt 200 coming into contact with the uppermost sheet S1 (i.e., the sheet attraction surface). By so doing, the attraction belt 200 can be separated from the sheet stack S simply by the swing of the attraction separation unit 201. Accordingly, there is no need to provide a device for lifting the attraction separation unit 201.

Further, with the roller 206 contacting a sheet, favorable separation performance can be obtained. Further, the roller 206 is configured to rotate together with a sheet, and does not rotate after the trailing edge of the uppermost sheet S1 passes under the roller 206. Accordingly, the subsequent sheet does not receive the conveying force.

In the sheet conveying device 220 disclosed in JP-2003-237969-A1, however, the rotary shaft of the upstream tension roller (i.e., the drive roller 203) is set as the center of swing of the attraction separation unit 201. Therefore, to set the location of the center of swing of the attraction separation unit 201 to a position upstream from the sheet attraction surface in the sheet conveyance direction, three rollers (i.e., the driven roller 202, the drive roller 203, and the tension roller 204) are needed to keep the attraction belt 200 taut. Different from these rollers 202, 203, and 204, the roller 206 is also disposed to provide the restorative force to the sheet when separating the sheet. This configuration, therefore, increases the number of components and therefore also the cost of the sheet conveying device 220.

BRIEF SUMMARY OF THE INVENTION

The present invention describes a novel sheet feeding device. In one example, a novel sheet feeding device includes a sheet feeder, a contact and separation drive unit, and a swing range adjuster. The sheet feeder feeds and conveys a sheet from a sheet container toward an image forming device, and includes a belt unit and a side holder. The belt unit includes an attraction belt disposed facing a sheet stack accommodated in the sheet container, a first tension roller to keep the attraction belt taut, and a second tension roller disposed upstream from the first tension roller in a sheet conveyance direction to keep the attraction belt taut together with the first tension roller. The side holder rotatably supports the belt unit that pivots about the first tension roller, and is pivotably mounted on a rotary shaft disposed upstream from the second tension roller of the belt unit in the sheet conveyance direction. The contact and separation drive unit swings the sheet feeder to make the attraction belt of the belt unit contact and separate from the sheet stack. The swing range adjuster includes an adjuster drive unit, a drive gear to transmit a drive force from the drive unit, and a rack mounted on a shaft of the second tension roller for meshing with the drive gear. The swing range adjuster adjusts a range of swing of the belt unit with respect to the side holder between a sheet contact position at which the attraction belt contacts an uppermost sheet of the sheet stack and a sheet separation position at which the contact and separation drive unit causes the attraction belt with the uppermost sheet attracted thereto to separate from the sheet stack.

The swing range adjuster may adjust the range of swing of the belt unit according to at least one of a sheet type and an environmental condition.

The swing range adjuster may adjust the range of swing of the belt unit in conveyance of a sheet having a higher rigidity than a reference sheet to be smaller than the range of swing of the belt unit in conveyance of the reference sheet.

The swing range adjuster may adjust the range of swing of the belt unit at a humidity detected by a humidity detector being higher than a reference humidity to be smaller than the range of swing of the belt unit at the reference humidity.

Components constituting the swing range adjuster other than the adjuster drive unit may be disposed outside the side holder of the sheet feeding unit.

The swing range adjuster may further include a drive transmission member disposed coaxially with a pivot of the sheet feeder to transmit a drive force to the drive gear.

The swing range adjuster may further include a timing belt by which the drive force is transmitted from the drive transmission member to the drive gear.

Further, in one example, a novel image forming apparatus includes an image forming device to form an image on a sheet, and the above-described sheet feeding device.

Further, in one example, a novel image forming apparatus includes the above-described sheet feeding device, a control unit operatively connected to the adjuster drive unit, an operation input unit operatively connected to the control unit to accept inputted information on material and thickness of sheets accommodated in the sheet feeding container, and a humidity detector operatively connected to the control unit.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1A:
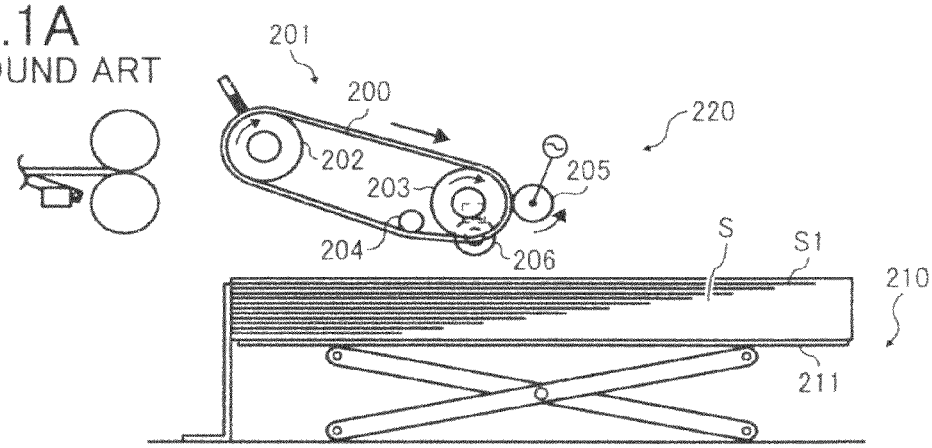
FIG.1A BACKGROUND ART
FIG. 1A is a schematic diagram of a related-art sheet conveying device in a standby state.
Figure 1B:
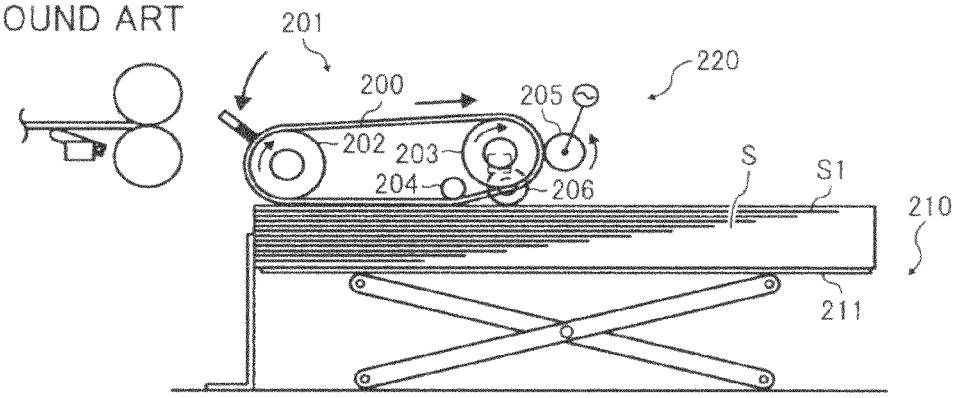
FIG.1B BACKGROUND ART
FIG. 1B is a schematic diagram of the related-art sheet conveying device of FIG. 1A in a sheet attraction state.
Figure 1C:
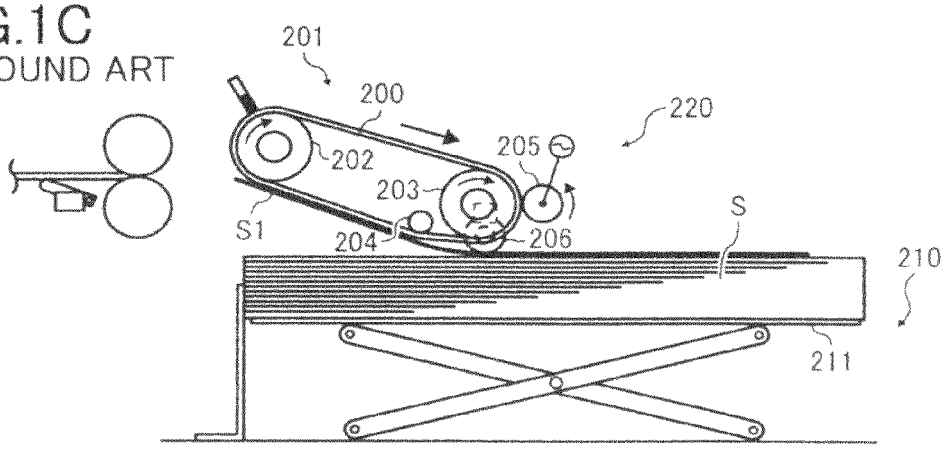
FIG.1C BACKGROUND ART
FIG. 1C is a schematic diagram of the related-art sheet conveying device of FIG. 1A in a sheet conveying state.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
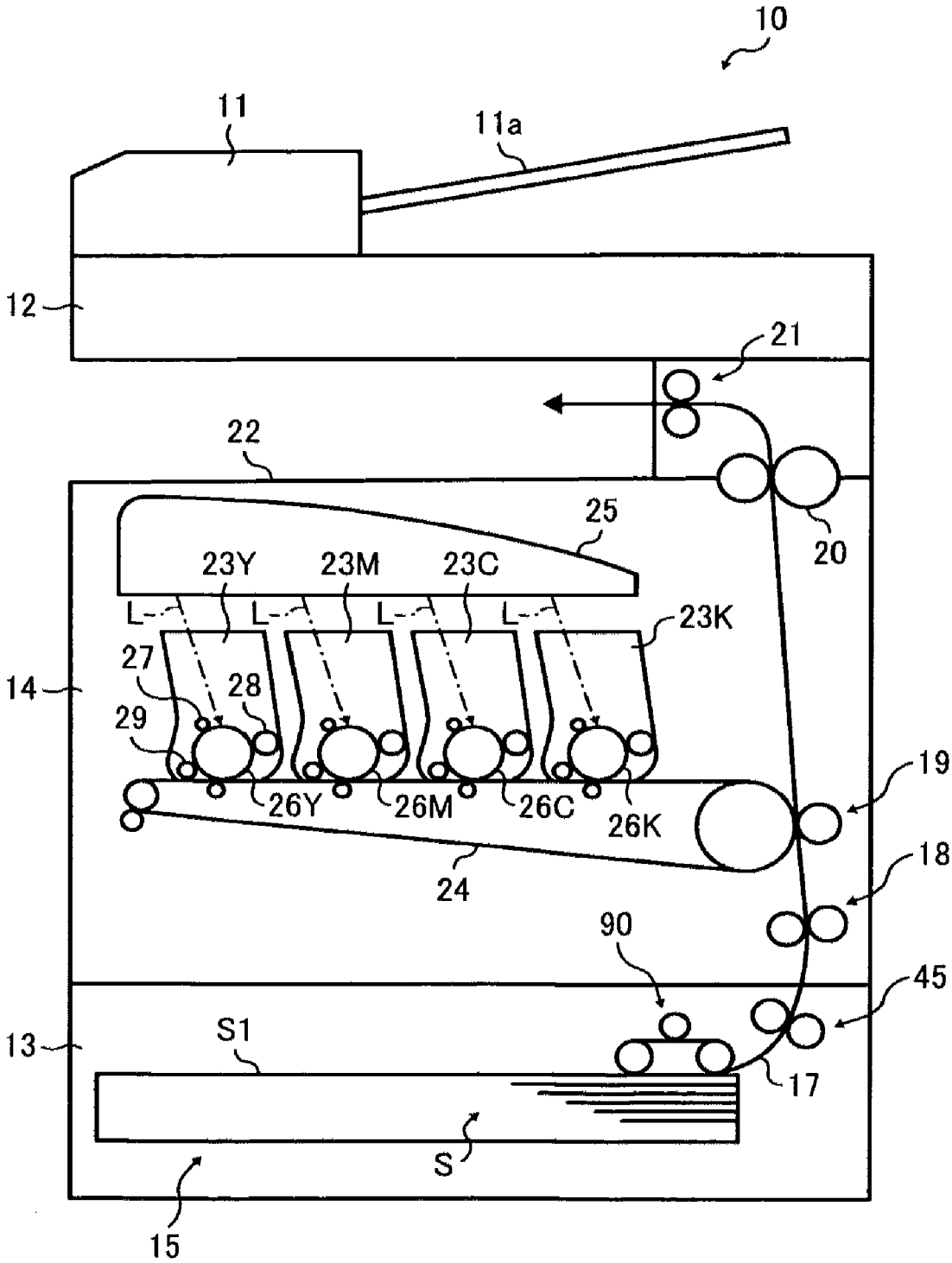
FIG. 2 is a schematic view of a copier serving as an image forming apparatus according to an example embodiment of the present invention.

FIG. 2 is a schematic view of an image forming apparatus 10 according to an embodiment of the present invention.

As illustrated in FIG. 2, an image forming apparatus 10 may be a copier, a facsimile machine, a printer, a multifunction printer having at least one of copying, printing, scanning, plotter, and facsimile functions, or the like. The image forming apparatus 10 may form an image by an electrophotographic method, an inkjet method, or any other suitable method. According to this embodiment, the image forming apparatus 10 functions as a copier 10 for forming an image on a recording medium by the electrophotographic method. Hereinafter, the image forming apparatus 10 is also referred to as the copier 10.

In FIG. 2, the copier 10 includes an automatic document feeder (hereinafter referred to as an "ADF") 11, a document reader 12, a sheet supplying device 13, an image forming device 14, a pair of registration rollers 18, a transfer roller 19, a fixing unit 20, a pair of sheet discharging rollers 21, a sheet discharging tray 22, and a pair of conveyance rollers 45.

The ADF 11 is mounted on the document reader 12, and includes a document sheet tray 11*a* to hold a document stack thereon. The ADF 11 separates each document one by one from the document stack on the document sheet tray 11*a* to automatically feed the separated document to the document reader 12.

The document reader 12 reads image data of the document fed from the ADF 11 on a contact glass mounted thereon.

The sheet supplying device 13 that serves as a sheet feeding device is disposed below the image forming device 14. The sheet supplying device 13 accommodates a sheet stack S or recording media therein to supply an uppermost sheet S1 that is picked up from the sheet stack S, to the image forming device 14.

The image forming device 14 to form an image on the uppermost sheet S1 supplied by the sheet supplying device 13 according to the image data read in the document reader 12.

According to this embodiment, the image forming device 14 can separate from the sheet supplying device 13 for supplying the uppermost sheet S1 to the image forming device 14.

The image forming device 14 includes four image forming units 23 (specifically, an image forming unit 23Y for forming yellow toner image, an image forming unit 23C for forming cyan toner image, an image forming unit 23M for forming magenta toner image, and an image forming unit 23K for forming black toner image), the intermediate transfer belt 24 that serves as an intermediate transfer member, and an optical writing device 25.

The optical writing device 25 receives color separation image data transmitted from an external device such as a personal computer or a word processor and image data of original documents read by the document reader 12 and converts the image data to a signal for light source driving. Accordingly, the optical writing device 25 drives a semiconductor laser in each laser light source unit and emits light beams L.

The image forming units 23Y, 23C, 23M, and 23K form respective single-color toner images different from each other. The image forming units 23Y, 23C, 23M, and 23K include a photoconductor 26 (specifically, a photoconductor 26Y for carrying yellow toner image thereon, a photoconductor 26C for carrying cyan toner image thereon, a photoconductor 26M for carrying magenta toner image thereon, and a photoconductor 26K for carrying black toner image thereon), and image forming components disposed around the photoconductor 26. The image forming components included in each of the image forming units 23Y, 23C, 23M, and 23K shown in FIG. 2 are a charging unit 27, a developing unit 28, and a cleaning unit 29.

The photoconductor 26 is a cylindrical image carrier that is rotated by a drive source, not illustrated in FIG. 2. The photoconductor 26 has a photoconductive layer as an outer surface thereof.

The charging unit 27 is disposed contacting the photoconductor 26 to uniformly charge the outer surface of the photoconductor 26. The charging unit 27 according to this embodiment employs a contact-type charging method in which a charging member such as a charging roller uniformly charges the outer surface of the photoconductor 26 by contacting or nearly contacting the outer surface of the photoconductor 26. However, a charging method is not limited thereto.

The light beams L or light spots emitted by the optical writing device 25 irradiate the outer surface of the photoconductor 26 to optically write an electrostatic latent image according to image data.

The developing unit 28 supplies toner to the outer surface of the photoconductor 26 to develop the electrostatic latent image into a visible toner image. In this embodiment, a non-contact type developing unit that does not directly contact the photoconductor 26 is employed.

The cleaning unit 29 is a brush-contact-type unit in which a brush member of the cleaning unit 29 is disposed slidably contacting the outer surface of the photoconductor 26 to remove residual toner remaining on the outer surface of the photoconductor 26.

The intermediate transfer belt 24 is an endless belt member including a resin film or a rubber material. The toner images formed on the respective outer surfaces of the photoconductors 26Y, 26C, 26M, and 26K are transferred subsequently from the photoconductor 26 onto a surface of the intermediate transfer belt 24 to form a composite color toner image before being further transferred onto the uppermost sheet S1 at the secondary transfer nip area formed by the transfer roller 19.

The uppermost sheet S1 having the composite color toner image thereon is conveyed to the fixing unit 20 to be fixed to the uppermost sheet S1 by application of heat and pressure, and is finally discharged to the sheet discharging tray 22 by the pair of sheet discharging rollers 21.

Figure 3:
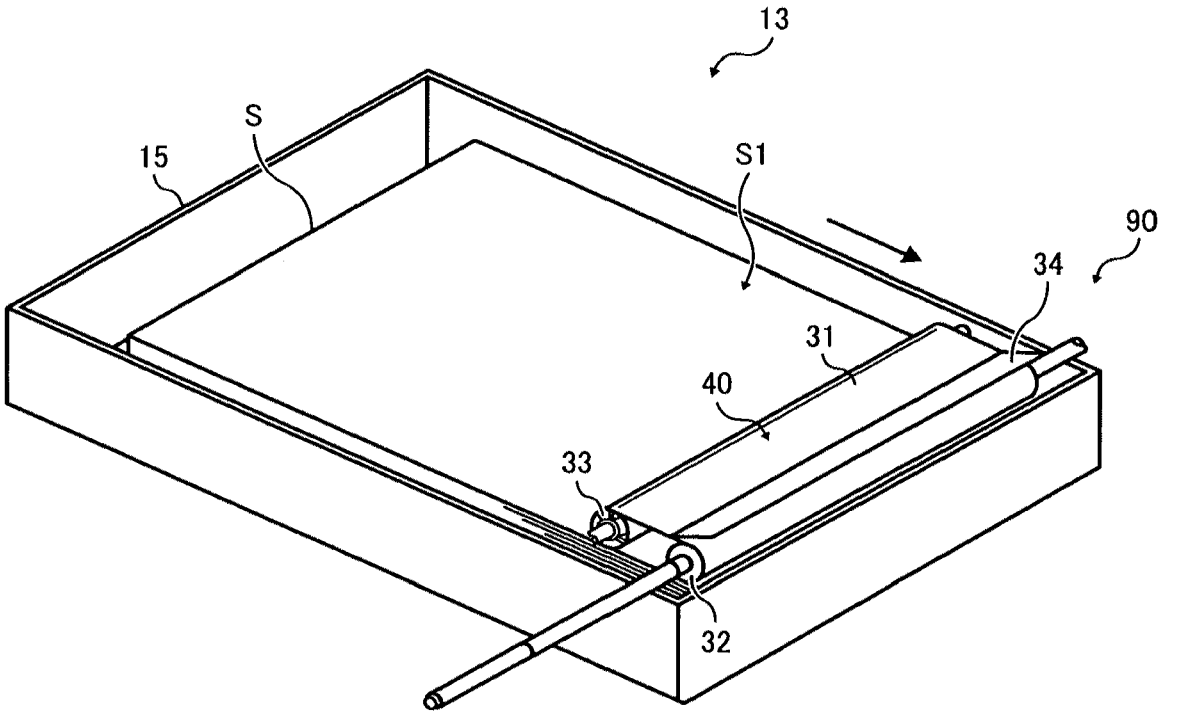
FIG. 3 is a perspective view of a sheet supplying device incorporated in the image forming apparatus shown in FIG. 2, according to an example embodiment of the present invention.

FIG. 3 is a perspective view of the sheet supplying device 13 incorporated in the copier 10.

As illustrated in FIGS. 2 and 3, the sheet supplying device 13 includes the sheet feed cassette 15 and a sheet feeding device 90.

The sheet feed cassette 15 serves as a sheet container and loads the sheet stack S therein to attract the uppermost sheet S1 placed on top of the sheet stack S to a sheet feeding unit 30 and pick up and feed the uppermost sheet S1 from the sheet stack S.

The sheet feeding device 90 includes an attraction belt unit 40 and separates and conveys the uppermost sheet S1. In FIG. 3, the attraction belt unit 40 is the only illustrated component of the sheet feeding device 90.

The uppermost sheet S1 picked up by the sheet feeding device 90 travels in a sheet conveyance pathway 17 (see FIG. 2) which passes through the pair of conveyance rollers 45 and then the nip area formed between the pair of registration rollers 18 and the secondary transfer nip area formed between the transfer roller 19 and a roller facing the transfer roller 19 with the intermediate transfer belt 24 interposed therebetween. Then, the uppermost sheet S1 is conveyed by the transfer roller 19 to a transfer portion in synchronization with the pair of registration rollers 18 at a predetermined time.

As illustrated in FIG. 3, the sheet feeding device 90 is disposed above the sheet cassette 15. A width along an axial direction of the sheet feeding device 90 is narrower or smaller than that of any sheet that can be loaded in the sheet cassette 15 and is disposed in the vicinity of the latitudinal center in the width direction of the loadable sheet. Alternatively, the width of the sheet feeding device 90 can be equal to or greater than that of any loadable sheet. Further, multiple sheet separation feeders 90 can be disposed along the width of any loadable sheet while one sheet feeding device 90 is provided in the vicinity of the latitudinal center in the width of the uppermost sheet S1 in the sheet supplying device 13 in FIG. 3.

The sheet feeding device 90 separates the uppermost sheet S1 from the sheet stack S with an electrostatic attraction method in which an electrical field that is generated on an endless dielectric belt acts on sheets to exert an attractive force. However, with the electrostatic attraction method, it is likely that the attractive force generated by the electrical field is exerted not only to the uppermost sheet S1 but also a second uppermost sheet and other subsequent sheets of the sheet stack S for a certain period of time after the attraction belt 31 contacts the uppermost sheet S1. If the period of time that the attraction belt 31 is held in contact with the uppermost sheet S1 is substantially long, the attraction belt 31 can make only the uppermost sheet S1 remain in contact. However, if the period of time the attraction belt 31 is held in contact with the uppermost sheet S1 is too long, the productivity of feeding and conveying sheets decreases, and therefore the sheet feeding device 90 may be less attractive in the market.

However, it is necessary to hold the attraction belt 31 in contact with the uppermost sheet S1 for a relatively long period of time to cause the attraction belt 31 to electrostatically attract only the uppermost sheet S1, and the reason is described below.

The attraction belt 31 is applied with alternating electrical charge $+\sigma$ and alternating electrical charge $-\sigma$. As the intervals of alternating electrical charge $+\sigma$ and electrical charge $-\sigma$ are smaller or narrower, the attractive force acting on the uppermost sheet S1 can reach the maximum value quicker, and the attractive force acting on the second and subsequent sheets can reach the minimum value quicker. The effects of the narrow intervals of alternating electrical charges $+\sigma$ and $-\sigma$ can be proven easily by calculating Maxwell stress at predetermined time intervals acting on each sheet. However, when the intervals of alternating electrical charges $+\sigma$ and $-\sigma$ are small, adjacent electrical potentials of the alternating electrical charges and $-\sigma$ are located close enough to negate or eliminate each other's electrical charges, and therefore the attractive force may become insufficient.

Further, if the adjacent electrical potentials of the alternating electrical charges $+\sigma$ and $-\sigma$ are located close to each other, the range or distance of electrical field generated on sheets in a direction of accumulation of the sheets may be reduced, and therefore the range or distance of the attractive force to be exerted to the sheet may be reduced. Consequently, the more the intervals of alternating electrical charges $+\sigma$ and $-\sigma$ decrease, the weaker the attractive force to be exerted to the uppermost sheet S1 to remain attracted to the attraction belt 31 becomes in a direction to the attraction belt 31. In other words, even slight separation of a small part or corner of the uppermost sheet S1 from the attraction belt 31 occurs, the uppermost sheet S1 can lose the attractive force easily. Therefore, to obtain the good sheet conveyance ability, the intervals of alternating electrical charges $+\sigma$ and $-\sigma$ should not be too small or narrow. If the intervals of alternating electrical charges $+\sigma$ and $-\sigma$ are large to some extent, the time that the attractive force acting on the second and subsequent sheets reaches the minimum value can be longer, and therefore the contact time of the attraction belt 31 to the uppermost sheet S1 to electrostatically attract only the uppermost sheet S1 to the attraction belt 31 can be longer.

Further, even if the period of time to hold the attraction belt 31 in contact with the uppermost sheet S1 is set long enough, the high adhesion between the uppermost sheet S1 and the subsequent sheet(s) of the sheet stack S may prevent the uppermost sheet S1 from separating from the subsequent sheet (i.e., the second sheet). For example, a coat sheet includes a coated surface layer, and therefore hygroscopicities or moisture absorptions are different on a cut surface and a print surface. Since the cut surface is more hygroscopic than the print surface, when the stack of sheets is left for a certain period of time, the cut surface absorbs moisture quicker than the print surface, and therefore the entire sheet can expand and the edge sides of adjacent sheets can adhere to each other. This can reduce the pressure at the center of the accumulated sheets, and as a result, the adhesion between the accumulated sheets can be stronger.

Accordingly, there are some cases that desirable separation cannot be performed due to productivity and type of sheet.

To avoid the above-described problem, a conventional sheet feeding device, Japanese Patent No. JP 3159727, discloses a technique in which a downstream tension roller among tension rollers that are wound around an attraction belt to extend with tension is disposed downstream from the leading edge of a sheet stack in a sheet conveyance direction and an arresting member such as a friction member that can stop or move an uppermost sheet 1*a* conveyed thereto in a direction opposite the sheet conveyance direction is disposed facing the attraction belt with a sheet feeding pathway formed therebetween. With this conventional technique, the second and sequent multiple sheets attracted to the attraction belt are separated from the attraction belt by friction with the arresting member. However, since the attractive force exerted by an electrical field of the attraction belt is also generated at the leading edge of the second or sequent sheets of the sheets attracted to the attraction belt, it is difficult in consideration of various conditions to use a method of mounting the arresting member pressed to contact with the attraction belt for separating the sheet reliably with the arresting member.

Therefore, in the sheet feeding device 90 according to this embodiment, the attraction belt 31 is rotated to turn up or pick up the sheet attracted to the attraction belt 31 from the sheet stack S. By adding this action, air is conveyed to the center of sheets accumulated in the sheet cassette 15, and therefore the attractive force exerted to the second and subsequent sheets can be made weaker quickly. Further, according to the above-described action, even if multiple sheets are attracted to the attraction belt 31, the second and subsequent sheets can be separated from the attraction belt 31 due to the restorative force of the sheet, thereby obtaining good separation ability. Therefore, even if the contact time of the sheet and the attraction belt 31 is short, the sheet can be separated from the attraction belt 31 reliably, thereby preventing poor productivity. A detailed description is given below.

Figure 4A:
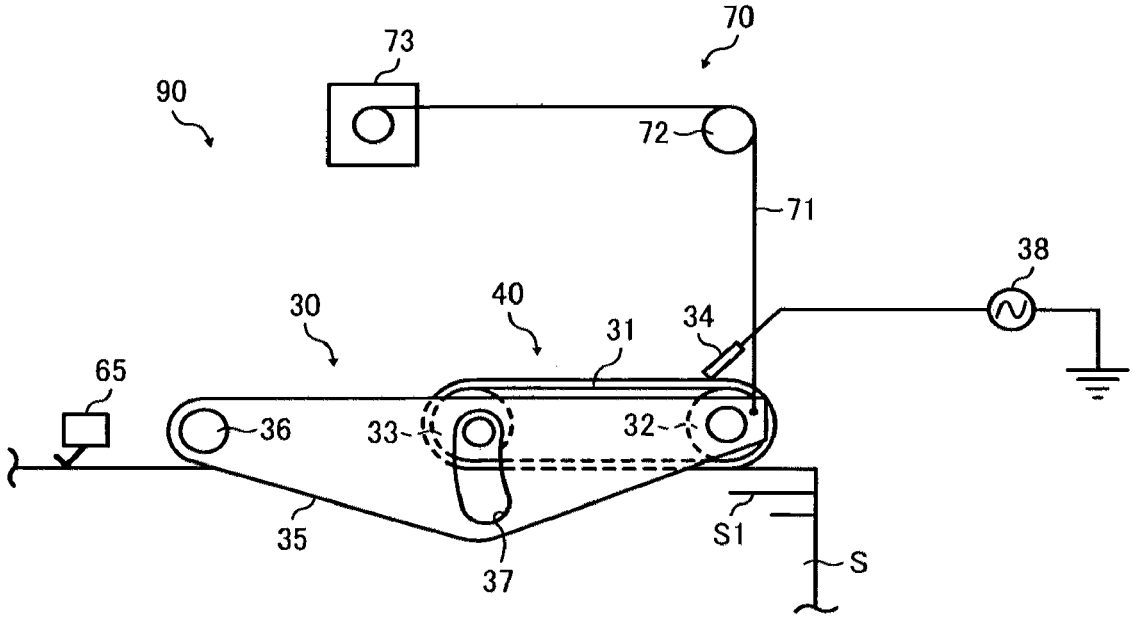
FIG. 4A is a schematic basic configuration of a sheet feeding device provided to the sheet supplying device of FIG. 3.
Figure 4B:
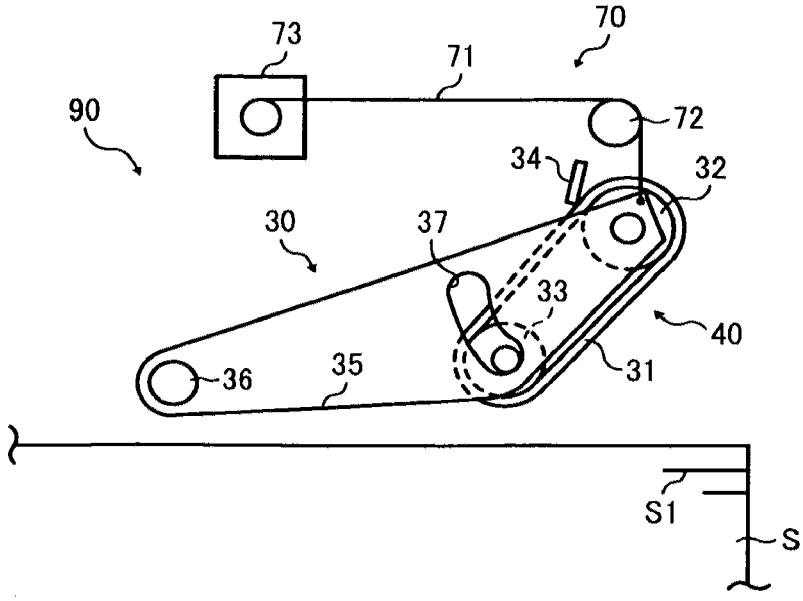
FIG. 4B is a schematic basic configuration of the sheet feeding device of FIG. 4A.

FIGS. 4A and 4B illustrate schematic diagrams of a basic configuration of the sheet feeding device 90. FIG. 4A illustrates a state in which the attraction belt 31 is held in contact with the uppermost sheet S1, and FIG. 4B illustrates a state in which the attraction belt 31 is separated from the uppermost sheet S1.

As illustrated in FIGS. 4A and 4B, the sheet feeding device 90 according to the present embodiment includes a sheet feeding unit 30 that serves as a sheet feeder. The sheet feeding unit 30 includes the belt unit 40 that includes a drive roller 32 that serves as a first tension roller, a driven roller 33 that serves as a second tension roller, and the attraction belt 31 that is wound around and extended by the drive roller 32 and the driven roller 33. The sheet feeding device 90 further includes side plates 35 that serve as a side holder, each of which is disposed at either end of a rotary shaft 36 and rotatably supports the belt unit 40 to swing about the drive roller 32 as a pivot.

The driven roller 33 is biased by a spring to the left in FIGS. 4A and 4B to tension the attraction belt 31. The attraction belt 31 is made of dielectric material having a resistivity not smaller than about $10^8$ Ω·cm. For example, the dielectric of the attraction belt 31 may be a polyethylene terephthalate film having a thickness of about 100 μm. Further, the attraction belt 31 has a multilayer construction that includes a front surface layer having a resistivity of about $10^8$ Ω·cm or greater and a back surface layer having a resistivity of about $10^6$ Ω·cm or smaller to maintain a good charging state. With the above-described multilayer construction, the back layer of the attraction belt 31 can be used as a grounded opposite electrode, and the charging member 34 to apply electrical charge to the attraction belt 31 can be disposed at any position that contacts the front surface layer of the attraction belt 31.

Further, the conductive rubber layer of the drive roller 32 is a front layer thereof having a resistivity of about $10^6$ Ω·cm. The driven roller 33 includes metal. The drive roller 32 and the driven roller 33 are electrically grounded. The drive roller 32 has a small diameter suitable for separating the sheet from the attraction belt 31 due to the curvature. That is, the diameter of the drive roller 32 is formed relatively small to make the curvature relatively large, and thus the sheet attracted and conveyed by the attraction belt 31 can be separated from the drive roller 32 and conveyed into a pathway defined by a guide member disposed at the downstream in the sheet conveyance direction.

Further, the drive roller 32 is configured to drive intermittently according to sheet feeding signals via an electro-magnetic clutch by a drive motor. The drive roller 32 and the driven roller 33 are rotatably supported by the side plates 35 of the sheet feeding unit 30. As described above, the side plates 35 are rotatably attached to or mounted on the rotary shaft 36.

The driven roller 33 that serves as an upstream-side tension roller in the sheet conveyance direction is rotatably supported by the side plates 35 to move along a slot 37 formed on each of the side plates 35. Specifically, the side plates 35 are disposed at both ends in the axial direction of the driven roller 33, and the driven roller 33 is supported thereto by inserting the shaft thereof into the slots 37. By contrast, the drive roller 32 is rotatably supported to the side plates 35. Specifically, the shaft of the driven roller 33 is rotatably supported by the side plates 35 via the bearings. To prevent variation of the distance between the center of rotation of the driven roller 33 and the center of rotation of the drive roller 32, the slots 37 are formed in a shape of an arc, the center of which corresponds to the center of rotation of the drive roller 32. As a result, the driven roller 33 moves along the slots 37 so that the driven roller 33 can rotate about the center of rotation of the drive roller 32, and even if the driven roller 33 moves along the slots 37, the distance between the center of rotation of the driven roller 33 and the center of rotation of the drive roller 32 can remain same. With this configuration, the belt unit 40 can rotate about the drive roller 32 that functions as a fulcrum of the belt unit 40 without changing the tension force of the attraction belt 31.

Each of the side plates 35 is swingably supported by the main body of the copier 10 to rotate about a pivot located upstream from the driven roller 33 that serves as a second tension roller in the sheet conveyance direction. Specifically, the side plates 35 are rotatably attached to the rotary shaft 36 that is disposed upstream from the driven roller 33 in the sheet conveyance direction. Further, one end of a wire 71 is fixed to a downstream end of each of the side plates 35 in the sheet conveyance direction. The wire 71 is connected via a wire collar 72 to a wire drive unit 73.

When the side plates 35 is in a state as illustrated in FIG. 4A, the wire drive unit 73 takes up the wire 71 and then the side plates 35 can rotate about the rotary shaft 36 in a counterclockwise in FIG. 4A. Then, the attraction belt 31 moves from a state as illustrated in FIG. 4A where that attraction belt 31 is held in contact with the uppermost sheet S1 of the sheet stack S to a state as illustrated in FIG. 4B where the attraction belt 31 separates from the sheet stack S. Specifically, in the present embodiment, the wire 71, the wire collar 72, and the wire drive unit 73 constitute a contact and separation drive unit 70.

Figure 5:
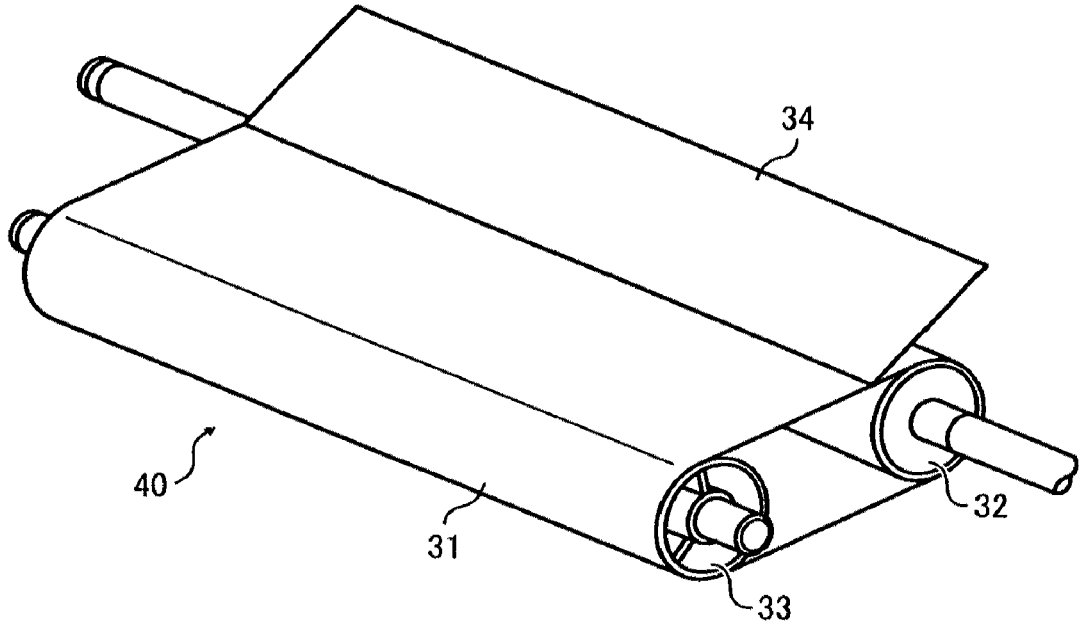
FIG. 5 is a perspective view of a sheet feeding unit incorporated in the sheet supplying device shown in FIG. 3.

FIG. 5 illustrates a configuration of the belt unit 40.

Figure 6:
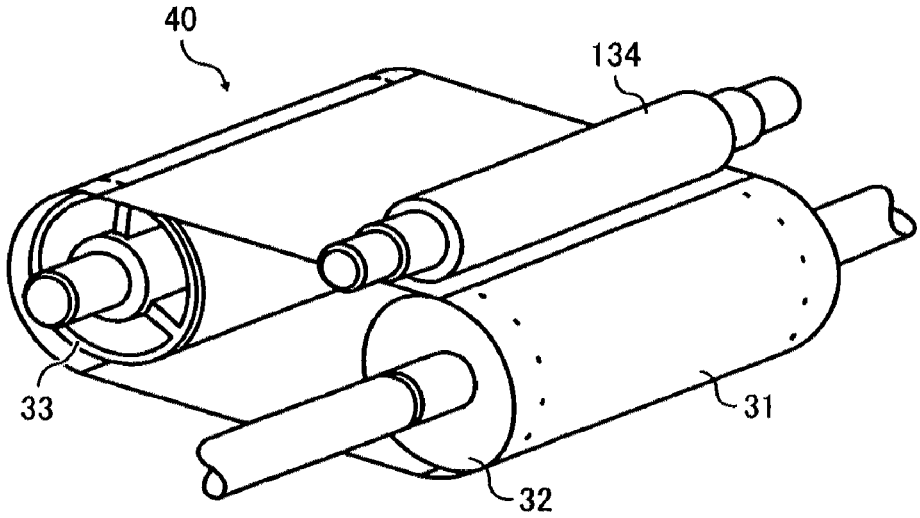
FIG. 6 is a perspective view of a variation of the sheet feeding unit of FIG. 5.
Figure 7:
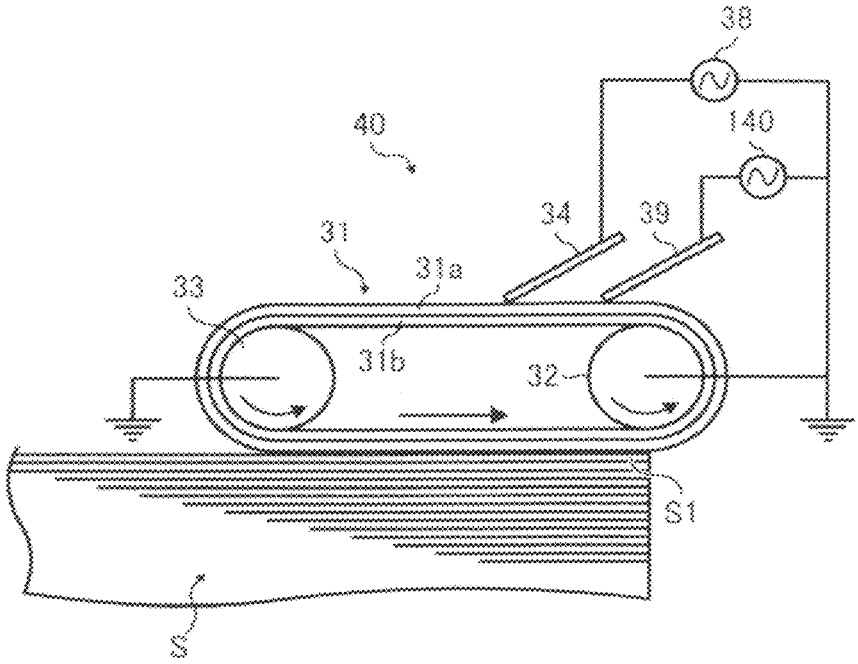
FIG. 7 is a side view of another variation of the sheet feeding unit of FIG. 5.

As described in FIG. 5, the belt unit 40 includes a blade-shaped charging member 34 that serves as a charging unit. The blade-shaped charging member 34 contacts the attraction belt 31 to uniformly charge the surface of the attraction belt 31 and is connected to an alternating-current power supply 38 that generates alternating current. Alternative to the blade-shaped charging member 34 used in the present embodiment, a roller-shaped charging member 134 can be used as illustrated in FIG. 6. Further, as illustrated in FIG. 7, an electrical discharging member 39 that is connected to an electrical discharging power source 140 that serves as an alternating power source can be disposed in contact or nearly contact with the attraction belt 31 at a position upstream from the charging member 34 in a direction of rotation of the attraction belt 31 and downstream from a sheet separation position where the attraction belt 31 separates from the sheet stack S. Further, as previously described the attraction belt 31 illustrated in FIG. 7 is a double layer structure that includes a front surface layer 31*a* formed of a dielectric member and a back surface layer 31*b* formed of a conductive member.

A description will be given of operations of sheet separation and conveyance using the sheet conveying device 90.

[Charging Operation]

First, a charging operation will be described. In the normal state, the sheet feeding unit 30 stands by at the position illustrated in FIG. 4B. Upon receipt of the sheet feeding signal, the electromagnetic clutch is turned on, and the drive roller 32 is driven to rotate and moves the attraction belt 31 circularly or endlessly. Then, the moving attraction belt 31 is supplied with an alternating voltage by the alternating-current power supply 38 via the charging member 34, so that the outer circumferential surface of the attraction belt 31 is formed with charge patterns that alternate with a pitch according to the frequency of the alternating-current power supply and the rotation speed of the attraction belt 31. Preferably, the pitch is set from approximately 2 mm to approximately 15 mm. As well as the alternating-current voltage, the alternating-current power supply 38 may also provide a direct-current voltage alternated between high and low potentials. In this embodiment, the outer circumferential surface of the attraction belt 31 is applied with a rectangular-wave voltage having an amplitude of from approximately 3 kV (kilovolts) to approximately 4 kV (±1.5 to ±2.0).

[Attraction Operation]

Figure 8:
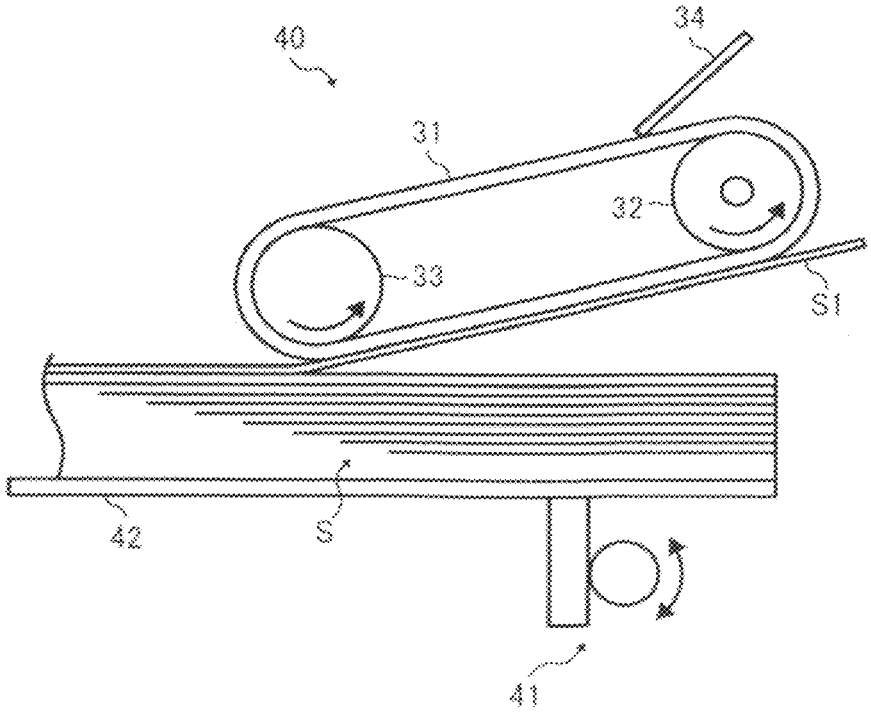
FIG. 8 is a side view of the sheet feeding unit of FIG. 5, illustrating an operation of separation of an uppermost sheet of the stack of sheets.

After the charge patterns are formed on the attraction belt 31 in the above-described manner, push-up members 41 using a rack and pinion mechanism (see FIG. 8) are rotated to lift a bottom plate 42. Almost simultaneously, the sheet feeding unit 30 is rotated in the clockwise direction in the drawings to move the attraction belt 31 to a sheet contact position thereof illustrated in FIG. 4A. In this process, the driven roller 33 is in contact with the lower end of each slot 37. As the bottom plate 42 is lifted, the uppermost sheet S1 of the sheet stack S contacts with the driven roller 33. Then, the bottom plate 42 is further lifted to push the driven roller 33 upward, and the driven roller 33 moves upward while being guided by the slots 37 and the belt unit 40 rotates in the clockwise direction. Then, upon contact of the driven roller 33 with the upper end of the slots 37, a sheet detecting unit 65 detects that the uppermost sheet S1 of the sheet stack S has arrived the predetermined position, and the lifting of the bottom plate 42 is stopped. In this state, a portion of the attraction belt 31 facing the upper surface of the sheet stack S contacts the uppermost sheet S1 of the sheet stack S.

As the attraction belt 31 thus comes into contact with the uppermost sheet S1, Maxwell stress acts on the uppermost sheet S1, which is a dielectric material, due to the electrical field generated by the charge patterns formed on the outer circumferential surface of the attraction belt 31. As a result, the uppermost sheet S1 of the sheet stack S is attracted to the attraction belt 31.

[Separation Conveyance Operation]

After the sheet feeding unit 30 stands by for a predetermined time in the state illustrated in FIG. 4A and the uppermost sheet S1 is attracted to the attraction belt 31, the side plate 35 of the sheet feeding unit 30 is rotated in the counterclockwise direction in the drawings. Then, the drive roller 32, which is the downstream-side tension roller in the sheet conveyance direction, moves together with the side plate 35 in a direction to separate from the sheet stack S. By contrast, the driven roller 33, which is the upstream-side tension roller in the sheet conveyance direction, does not move from the upper surface of the sheet stack S due to the weight thereof, and moves away from the side plate 35 and toward the sheet stack S. With this configuration, the attraction belt 31 of the belt unit 40 moves to swing about the center of rotation of the driven roller 33, and a sheet attracted to the attraction belt 31 is bent at a portion of the attraction belt 31 wound around the driven roller 33 (see FIG. 8). As a result, the restorative force acts on the sheet attracted to the attraction belt 31. Accordingly, only the uppermost sheet S1 is attracted to the attraction belt 31, and the second and subsequent sheets are separated from the attraction belt 31 by the restorative force of the sheet.

If the side plate 35 is further rotated in the counterclockwise direction in the drawings, the driven roller 33 will abut against the lower end of each slot 37 formed on the side plate 35. If the side plate 35 is further rotated in this contact state of the driven roller 33 with the lower end of each slot 37, the driven roller 33 will move together with the side plate 35 to separate the attraction belt 31 from the upper surface of the sheet stack S. Then, the rotation of the side plate 35 is stopped in the state illustrated in FIG. 4B. After the rotation of the side plate 35 is stopped, the electromagnetic clutch is turned on to drive the drive roller 32 to rotate, and therefore the attraction belt 31 is rotated, and the uppermost sheet S1 attracted to the attraction belt 31 is conveyed toward the pair of conveyance rollers 45 (see FIG. 2). As the leading edge of the uppermost sheet S1 electrostatically attracted to the attraction belt 13 reaches a corner where an inner side of the attraction belt 31 contacting the drive roller 32, the uppermost sheet S1 bends along the curvature of the arc about the outer circumference of the attraction belt 31 at or in the vicinity of the driven roller 33, separates from the attraction belt 31 due to curvature separation, and moves toward the pair of conveyance rollers 45 while being guided by a guide member.

The pair of conveyance rollers 45 and the attraction belt 31 are controlled to have the same linear velocity. Therefore, if the pair of conveyance rollers 45 is intermittently driven to adjust the timing, the attraction belt 31 is also controlled to be intermittently driven.

Further, the attraction belt 31 may be charged only over the length from the sheet separation position of the attraction belt 31 to the pair of conveyance rollers 45, and the attraction belt 31 may be thereafter electrically discharged by the charging roller 34. With this configuration, the uppermost sheet S1 conveyed to the pair of conveyance rollers 45 is then conveyed solely by the conveying force of the pair of conveyance rollers 45 with no influence from the attraction belt 31. Further, with the discharge of the attraction belt 31, the second sheet separated from the attraction belt 31 can be prevented from being electrostatically attracted back to the attraction belt 31.

Figure 9A:
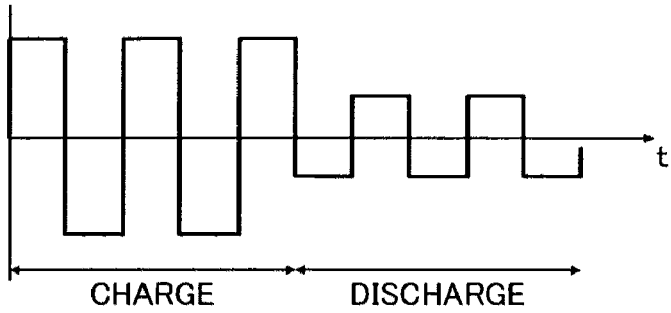
FIG. 9A is a schematic diagram illustrating square waves for charging and discharging a belt included in the sheet feeding unit shown in FIG. 5.
Figure 9B:
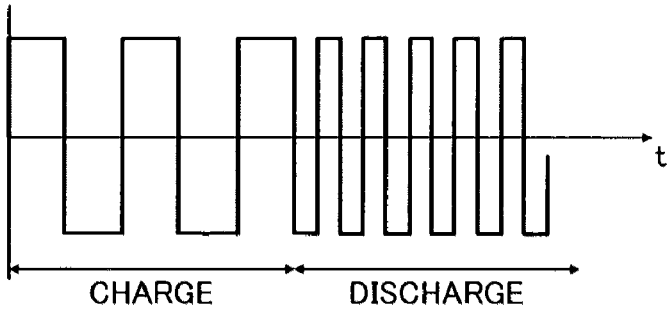
FIG. 9B is another schematic diagram illustrating square waves for charging and discharging a belt included in the sheet feeding unit shown in FIG. 5.

FIGS. 9A through 9B show schematic diagrams illustrating waveforms for charging and discharging the attraction belt 31 while the attraction belt 31 is moving.

As illustrated in FIG. 9A, a voltage is controlled to charge and discharge the surface of the attraction belt 31. For example, the voltage applied by the charging member 34 may be decreased to remove the charge pattern formed on the surface of the attraction belt 31.

As illustrated in FIG. 9B, frequency of the charging member 34 may be increased to shorten the pitches of the charge pattern formed on the surface of the attraction belt 31. Thus, the force of attraction of the attraction belt 31 for attracting the uppermost sheet S1 may be decreased according to Maxwell stress.

Figure 9C:
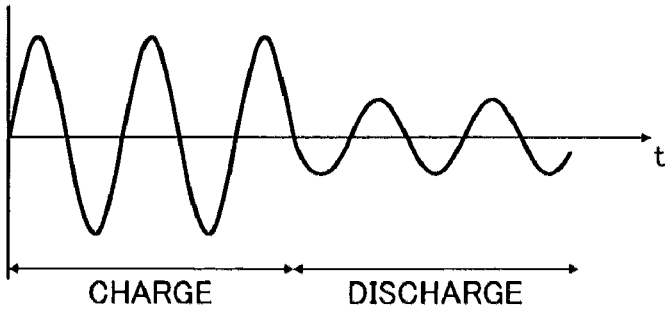
FIG. 9C is a schematic diagram illustrating sine waves for charging and discharging a belt included in the sheet feeding unit shown in FIG. 5.
Figure 9D:
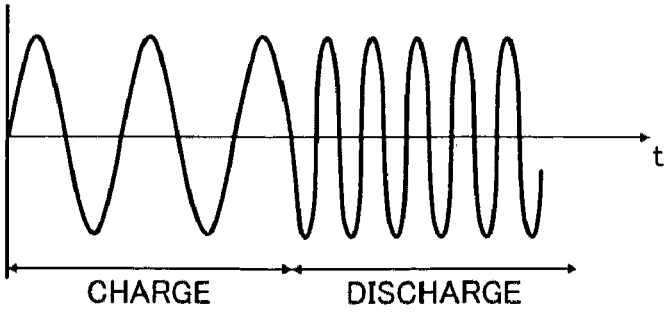
FIG. 9D is another schematic diagram illustrating sine waves for charging and discharging a belt included in the sheet feeding unit shown in FIG. 5.

FIGS. 9A and 9B illustrate square waves formed by the direct current alternately applied. Similarly, the alternating current may be used. FIGS. 9C and 9D illustrate sine waves formed by the alternating current, which are used in an embodiment of the present invention.

Further, if paper dust and other foreign materials adhere to the attraction belt 31, the electrostatic attraction may be adversely affected. To avoid this problem, a cleaning unit may be provided to the sheet feeding device 90 to clean the surface of the attraction belt 31 by removing the paper dust and other foreign materials adhering to the attraction belt 31.

Next, a detailed description is given of the sheet feeding device 90.

In the above-described sheet feeding device 90, the attraction belt 31 separates from the sheet stack S as the driven roller 33 contacts the lower end of the slots 37. Therefore, an angle of swing of the attraction belt 31 that is formed when the driven roller 33 moves to separate from the sheet stack S (i.e., the surface of the attraction belt 31 contacting the uppermost sheet 51 of the sheet stack S and the surface of the uppermost sheet S1 of the sheet stack S) can be maintained constant. However, the sheet feeding device 90 is required to be flexible in feeding sheets of different types under various environmental conditions. Accordingly, the sheet feeding device 90 according to the present embodiment is configured to adjust the angle of swing of the attraction belt 31 according to the type of sheet and various environmental conditions.

Figure 10:
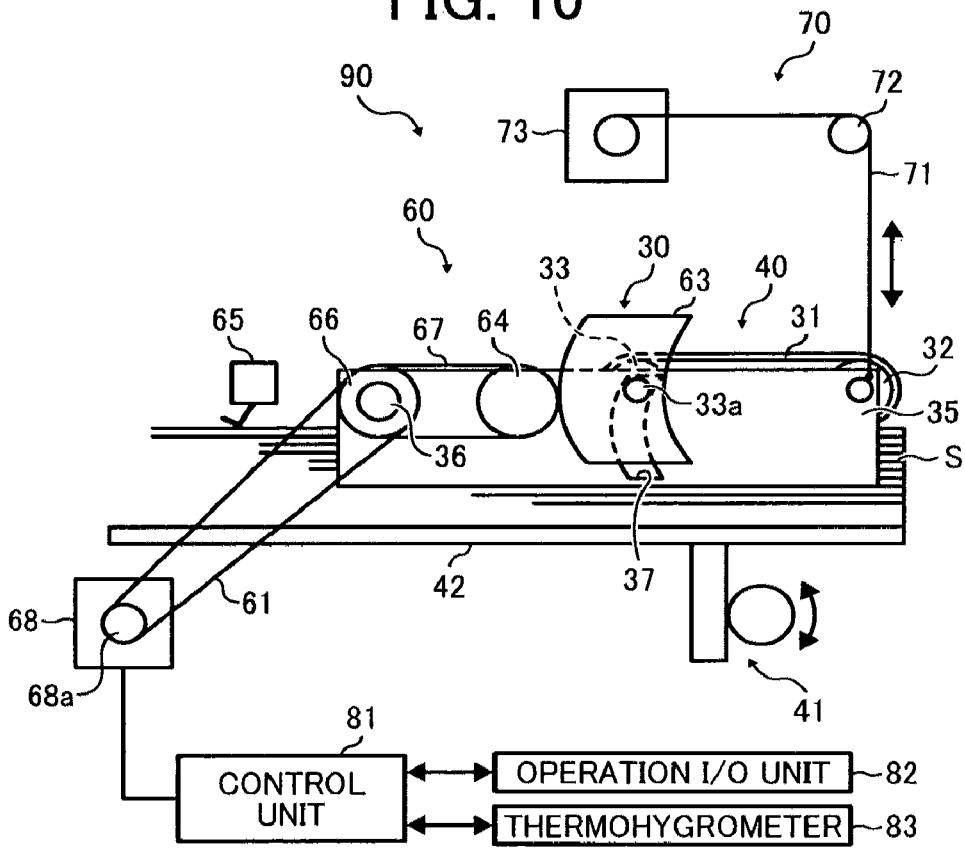
FIG. 10 is a schematic configuration of the sheet feeding unit according to an embodiment of the present invention.

FIG. 10 illustrates a configuration of the sheet feeding device 90.

As illustrated in FIG. 10, the sheet feeding device 90 includes a swing range adjusting unit 60 that serves as a swing range adjuster to change or adjust the range of swing of the belt unit 40 by changing the range of movement of the driven roller 33 along the slots 37.

The swing range adjusting unit 60 includes a rack 63 and a pinion gear 64. The rack 63 is fixedly attached via bearings at both ends of a shaft 33*a* of the driven roller 33 that is movably supported by the side plates 35 by passing through the slots 37. Specifically, the bearings have D-shaped outlines and the racks 63 have respective D-shaped openings so that the D-shaped outlines of the bearings are engaged with the respective D-shaped openings of the racks 63 and the racks 63 are screwed to the respective bearings. The pinion gear 64 that is engaged with the rack 63 is rotatably attached to the side plates 35. A first pulley is mounted to the shaft 33*a* coaxially with the pinion gear 64. A second pulley 66 and a third pulley are rotatably mounted to the rotary shaft 36. A driven timing belt 67 is wound around the first pulley and the second pulley 66, and a drive timing belt 61 is wound around the third pulley and a driven shaft 68*a* of an adjuster drive unit 68. It is more preferable that the components constituting the swing range adjusting unit 60 other than the adjuster drive unit 68 (that is, the components are the rack 63, the pinion gear 64, the first pulley, the second pulley 66, the third pulley, the driven timing belt 67, and the drive timing belt 61) are disposed outside the side plates 35 of the sheet feeding unit 30, located symmetrically at opposite ends in the long axis thereof, and caused to operate at both sides. Further, the sheet feeding unit 30 is configured to rotate relatively with the shaft 33*a* of the driven roller 45, and therefore the bearings are provided therebetween to rotatably support the shaft 33*a* of the driven roller 33.

The swing range adjusting unit 60 according to the present embodiment includes the second pulley 66 that serves as a drive transmission member and the third pulley attached to the rotary shaft 36 that serves as a pivot of the sheet feeding unit 30, so that the drive force of the adjuster drive unit 68 can be transmitted to the pinion gear 64 via the second pulley 66 and the third pulley. With this configuration, even if the sheet feeding unit 30 rotates, the distance between the first pulley that is mounted to the shaft 33*a* coaxially with the pinion gear 64 and the second pulley 66 that is mounted to the rotary shaft 36 can be maintained constant, thereby preventing the driven timing belt 67 that is wound around the first pulley and the second pulley 66 from being pulled or sagged. Similarly, the drive timing belt 61 that is wound around the third pulley mounted to the rotary shaft 36 and the drive timing belt 61 that is wound around the drive shaft 68*a* cannot be pulled or sagged even if the sheet feeder unit 30 rotates. Accordingly, even if the sheet feeding unit 30 moves or rotates, the drive force of the adjuster drive unit 68 can be transmitted reliably.

The adjuster drive unit 68 is connected to a control unit 81. The control unit 81 may be implemented as a CPU (Central Processing Unit) serving as an operation device and various memory units, including a RAM (Random Access Memory) serving as a temporary storage device, a ROM (Read-Only Memory) serving as a non-volatile memory, and/or a flash memory (FM) storing tables. Further, the control unit 81 controls the overall operation of the sheet feeding device 90, and is connected to an operation input unit 82 and a thermohygrometer 83 that serves as a humidity detector. The thermohygrometer 83 is embedded in the sheet supplying device 13. The control unit 81 controls the adjuster drive unit 68 based on the detection results obtained by the thermohygrometer 83. Humidity can also be detected by a different humidity detector that is incorporated in the copier 10. Further, the control unit 81 can obtain such information as the material and thickness of sheets accommodated in the sheet cassette 15 by input or selection operation by a user through the operation input unit 82. Specifically, the operation input unit 82 functions as a sheet information input unit. For example, as information of rigidity and stiffness of sheet, values measured by Clark method ($cm^3$/100, JIS P 8143) or paper weight of sheet ($g/m^2$) are input in the operation input unit 82. Generally, a thick paper having a large paper weight ($g/m^2$) has a high rigidity of sheet, and a thin paper having a small paper weight ($g/m^2$) has a low rigidity of sheet. Therefore, the rigidity of sheets set in the sheet cassette 15 can be obtained based on the paper weight ($g/m^2$).

Further, the above-described sheet information can be obtained from a label attached to a wrapping paper or package that wraps the sheet stack S. For example, when the sheet stack S is set in the sheet cassette 15, a screen is displayed for a user to input a product number printed on the label to a specific area of the operation input unit 82. The control unit 81 has prestored therein a table associated with product numbers, rigidity of sheets (values and paper weights obtained by Clark method), electrical resistances, and so forth, and therefore can obtain the information (i.e., rigidity and electrical resistance) of the sheets set in the sheet cassette 15 based on the product number inputted by the user. Then, the control unit 81 controls the adjuster drive unit 68 based on the thus-obtained sheet information. Further, the control unit 81 may control the pitch and voltage of the electrical charge and attraction time (a period of time the attraction belt 31 is held in contact with the sheet stack S) of the attraction belt 31. With the above-described operations performed by the control unit 81, the attraction belt 31 can attract the sheet stack S with a suitable type and environmental condition of the sheet to be separated and conveyed. For example, in a case in which a sheet having a relatively high electrical resistance is attracted, the attraction belt 31 may need a longer time to obtain a sufficient attractive force to attract the sheet. Therefore, the control unit 81 causes the attraction belt 31 to attract the sheet for a longer period of time.

By driving the adjuster drive unit 68, the pinion gear 64 is rotated and the rack 63 is moved, and thus the shaft 33*a* of the driven roller 33 moves along the slots 37. The control unit 81 specifies the period of driving time of the adjuster drive unit 68 based on the detection results obtained by the thermohygrometer 83 and sheet information. After the adjuster drive unit 68 has been driven for the specified period of driving time, the control unit 81 stops driving of the adjuster drive unit 68. Then, the shaft 33*a* of the driven roller 33 stops at a predetermined position in the slots 37. Thus, by using the pinion gear 64, the rack 63, and the adjuster drive unit 68, the range of movement of the driven roller 33 along the slots 37 can be set arbitrarily.

After the charging operation and the attraction operation have been performed as described above, the control unit 81 drives the adjuster drive unit 68 in synchronization with the operation to drive the wire drive unit 73 to separate the attraction belt 31 from the sheet stack S. With this operation, the side plates 35 rotate about the rotary shaft 36, the drive roller 32 then moves together with the side plates 35 in a direction to separate from the sheet stack S, and the driven roller 33 is moved due to the drive force exerted by the adjuster drive unit 68 to the sheet stack S relative to the side plates 35. With the above-described series of actions, the attraction belt 31 of the belt unit 40 swings about the center of rotation of the driven roller 33, and therefore the sheet attracted to the attraction belt 31 curves at a corner where the inner side of the attraction belt 31 contacting the driven roller 33 as a fulcrum. Accordingly, the restorative force is exerted to the sheet attracted to the attraction belt 31, which can attract only the uppermost sheet S1 to the attraction belt 31 and separate the second and subsequent sheets from the uppermost sheet 51.

Figure 11:
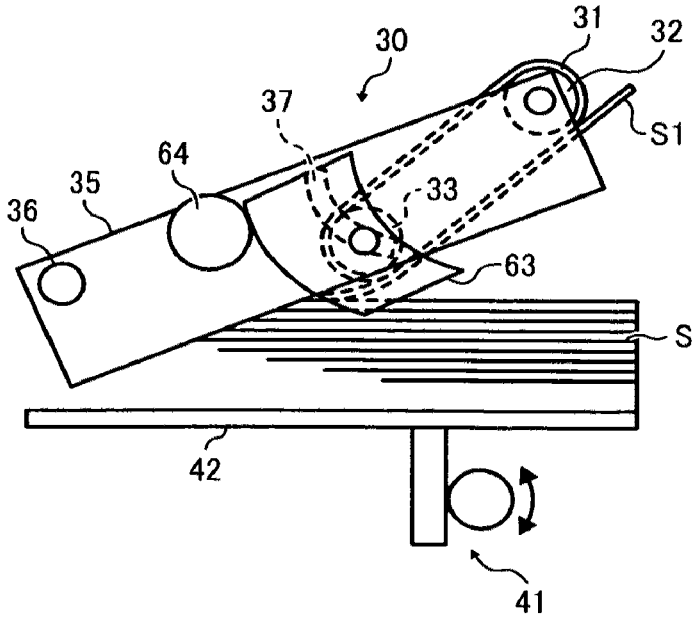
FIG. 11 is a diagram of an example of a stop position of a driven roller in a slot in the sheet feeding unit.

Then, when the period of time to drive the adjuster drive unit 68 reaches a given drive time determined based on sheet type information and environmental information, the control unit 81 stops the driving of the adjuster drive unit 68. For example, when thick papers or sheets having rigidity are accommodated in the sheet cassette 15 or when the uppermost sheet S1 is likely to separate from the attraction belt 31 due to the large angle of swing of the attraction belt 31 under the high-humidity condition, the driving of the adjuster drive unit 68 is stopped before the driven roller 33 comes into contact with the lower end of each slot 37. By contrast, even if the driving of the adjuster drive unit 68 is stopped, the wire drive unit 73 continues to drive to rotate the side plates 35 in the counterclockwise direction as illustrated in FIG. 10. Consequently, as illustrated in FIG. 11, the driven roller 33 can separate from the upper surface of the sheet stack S without reaching and contacting the lower end of each slot 37. With this action, when compared with a configuration in which the drive roller 33 separates from the upper surface of the sheet stack S after the driven roller 33 has come into contact with and abutted against the lower end of each slot 37, the range of swing of the belt unit 40 can be shorter and therefore the angle of swing of the attraction belt 31 formed when the driven roller 33 separates from the upper surface of the sheet stack S can be smaller. As a result, even at separation and conveyance of the sheet having rigidity or under the high humidity condition, the uppermost sheet S1 can be conveyed reliably without being separated from the attraction belt 31, thereby preventing occurrence of the sheet conveyance failure.

Further, when the sheets having a lower electrical resistance, that is, the sheets having a relatively small attractive force to the attraction belt 31 are accommodated in the sheet cassette 15, the driving of the adjuster drive unit 68 is stopped before the driven roller 33 comes into contact with the lower end of the respective slots 37 to make the angle of swing of the attraction belt 31 small when the driven roller 33 separates from the sheet stack S. By so doing, even if the attractive force of the sheet is small, the restorative force of the sheet cannot be greater than the attractive force of the sheet, thereby preventing the separation of the uppermost sheet S1 from the attraction belt 31.

On the other hand, if thin papers having a relatively small rigidity are accommodated in the sheet feed cassette 15 or if the sheets in the sheet feed cassette 15 are stored in a low humidity condition that makes it difficult for the second and subsequent sheet to be separated from the attraction belt 31 at a small angle of swing thereof, the control unit 81 can cause the adjuster drive unit 68 to continue to drive longer until the driven roller 33 abuts against the lower end of the respective slots 37. With this operation, the range of swing of the belt unit 40 can become greater, and the angle of swing of the attraction belt 31 can be set larger. Therefore, with separation and conveyance of a sheet having a small rigidity or under the low humidity condition, the second and subsequent sheets can be separated from the attraction belt 31 reliably. Accordingly, a multi-feed error in which multiple sheets are fed at one time can be prevented.

Further, in this embodiment, the side plate 35 includes the slot 37 by which the drive roller 33 is movably supported, but the configuration is not limited thereto. For example, the sheet feeding device 90 can have a configuration in which the driven roller 33 is rotatably supported such that the driven roller 33 moves about the center of rotation of the drive roller 32 in an arc in a direction to separate from the upper surface of the sheet stack S. Specifically, a slot for supporting the driven roller 33 can be formed on the side plate 35, with a side surface closer to the drive roller 32 having a curvature of an arc formed about the center of rotation of the drive roller 32, and the slot may have a substantially rectangular shape that extends in a direction to separate from the upper surface of the sheet stack S. Further, the sheet feeding device 90 employs the side plates 35 to serve as a side holder. However, as an alternative member to the side plates 35, a frame with slots to movably support the drive roller 33 can be applied to the sheet feeding device 90, achieving the same effect as the configuration having the side plates 35 in the sheet feeding device 90.

Further, the above-described configuration of the sheet feeding device 90 causes the attraction belt 31 to attract the uppermost sheet S1 of the sheet stack S electrically. However, the uppermost sheet S1 of the sheet stack S can be attracted to the attraction belt 31 using air.

Figure 12A:
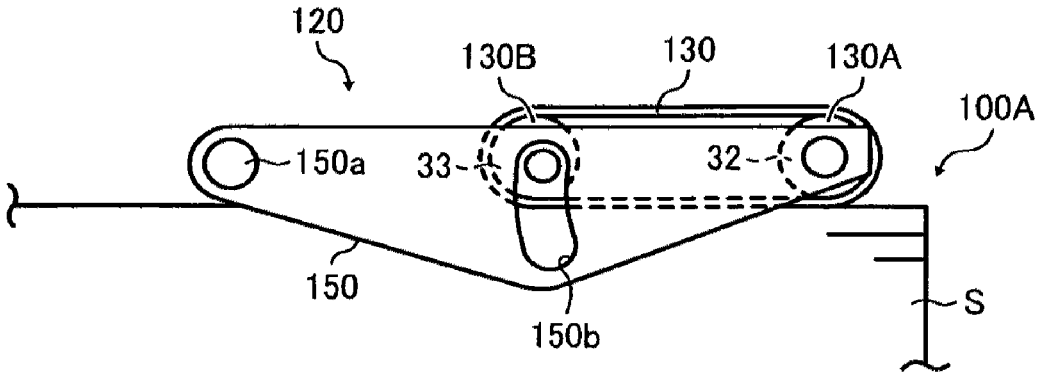
FIG. 12A is a schematic diagram of a comparative sheet conveying device in a sheet attraction state.
Figure 12B:
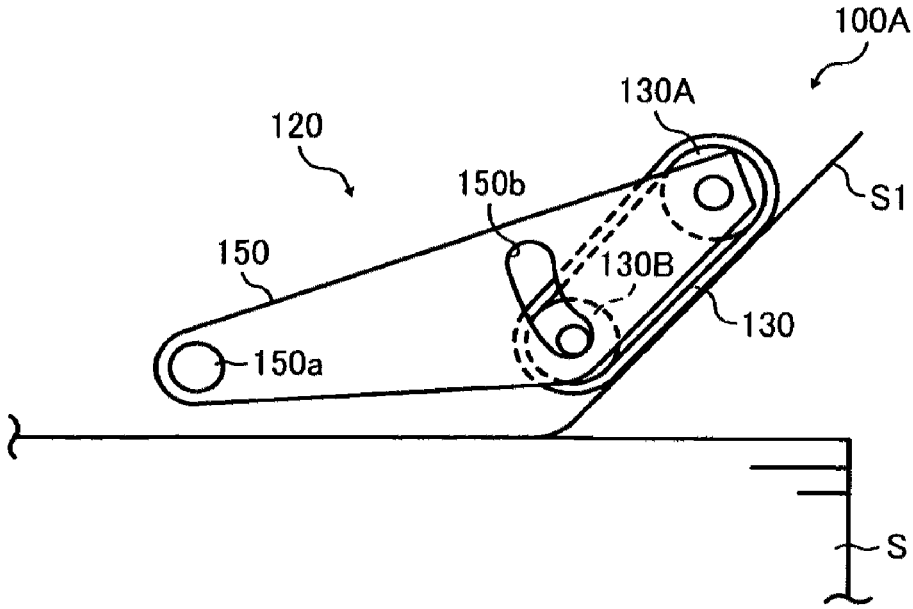
FIG. 12B is a schematic diagram of the comparative sheet conveying device of FIG. 12A in a sheet conveying state.

Here, a description is given of a comparative sheet conveying device 100A with reference to FIGS. 12A and 12B.

FIGS. 12A and 12B illustrate diagrams of the comparative sheet conveying device 100A. FIG. 12A illustrates a state in which a sheet is attracted to an attraction belt 130, and FIG. 12B illustrates a state in which the sheet is conveyed toward an image forming device, for example.

As illustrated in FIGS. 12A and 12B, the comparative sheet conveying device 100A includes an attraction separation unit 120. The attraction separation unit 120 includes an attraction belt unit and a side plate 150.

The attraction belt unit 120 includes a drive roller 130A that serves as a first tension roller, a driven roller 130B that serves as a second tension roller, and an attraction belt 130 that is wound around the drive roller 130A and the driven roller 130B. The attraction belt unit 120 is swingably supported by the side plate 150.

The side plate 150 has a slot 150*b* that rotatably supports the driven roller 130B therealong so that the drive roller 130A is rotatably supported with respect to the side plate 150. The side plate 150 is fixedly attached to a rotary shaft 150*a* that is disposed upstream from the driven roller 130B in the sheet conveyance direction. The rotary shaft 150*a* is connected to a drive unit, which is not illustrated.

If the rotary shaft 150*a* is rotated in a counterclockwise direction by the drive unit, the side plate 150 is also rotated in the counterclockwise direction. According to this action, the drive roller 130A in the state illustrated in FIG. 12A moves together with the side plate 150 in a direction to separate from the sheet stack S. By contrast, the drive roller 130B does not move from the upper surface of the sheet stack S due to the weight thereof, and moves away from the side plate 150 and toward the sheet stack S relatively. Thereby, the attraction belt 130 of the attraction belt unit 120 moves to swing around the center of rotation of the driven roller 130B, and a sheet attracted to the attraction belt 130 is wrapped around a portion of the attraction belt 130 wound around the driven roller 130B. As a result, restorative force acts on the sheet attracted to the attraction belt 130. Accordingly, only the uppermost sheet S1 is attracted to the attraction belt 130, and the subsequent sheet is separated from the attraction belt 130 by the restorative force of the sheet.

If the side plate 150 is further rotated in the counterclockwise direction in the drawings, the driven roller 130B will abut against the lower end of the slot 150*b*. If the side plate 150 is further rotated in this state of contact between the driven roller 130B and the lower end of the slot 150*b*, the driven roller 130B will move together with the side plate 150 and separate from the upper surface of the sheet stack S. Then, the rotation of the side plate 150 is stopped in the state illustrated in FIG. 12B. After the rotation of the side plate 150 is stopped, the electromagnetic clutch is turned on to drive the drive roller 130A to rotate, then the attraction belt 130 is rotated, and the uppermost sheet S1 attracted to the attraction belt 130 is fed forward.

In the comparative sheet conveying device 100A, a pivot of the attraction separation unit 120 is disposed upstream from the rotary shaft of the upstream-side roller in the sheet conveyance direction (i.e., the driven roller 130B) in the sheet conveyance direction. By so doing, even with the configuration in which two tension rollers (i.e., the drive roller 130A and the driven roller 130B) extend the attraction belt 130 with tension, the pivot of the attraction separation unit 120 can be disposed upstream in the sheet conveyance direction from an area in which the attraction belt 130 contacts the uppermost sheet S1. Accordingly, this configuration enables the attraction belt 130 to separate from the sheet stack S by swingably moving the attraction separation unit 120.

Further, compared with the related-art sheet conveying device 220 in which the attraction separation unit 201 swings or rotates about the rotary shaft of the upstream-side tension roller in the sheet conveyance direction (i.e., a drive roller 203), the comparative sheet conveying device 100A can swing or rotate the attraction separation unit 120 that is tensioned by fewer tension rollers so as to separate the attraction belt 130 from the sheet stack S. As a result, the number of components of the comparative sheet conveying device 100A can be less than the number of components of the sheet conveying device 220.

Further, the comparative sheet conveying device 100A includes the slot 150*b* formed on the side plate 150 to support the upstream-side tension roller 130B in the sheet conveyance direction to the slot 150*b*. With this configuration, the attraction separation belt unit 120 is swingably supported to the side plate 150 with the drive roller 130A serving as a first tension roller as a pivot thereof. As a result, when separating the uppermost sheet S1 from the sheet stack S, the upstream-side tension roller 130B in the sheet conveyance direction contacts the sheet stack S so that the uppermost sheet S1 attracted to the attraction belt 130 can exert the restorative force. Further, after the uppermost sheet S1 has been separated from the sheet stack S, the upstream-side tension roller 130B in the sheet conveyance direction contacts the lower end of the slot 150*b*, thereby separating the driven roller 130B from the upper surface of the sheet stack S. Accordingly, a second sheet that lies subsequently from the uppermost sheet S1 on the sheet stack S may not be affected by the conveyance force of the attraction belt 130 when the uppermost sheet S1 is conveyed by the attraction belt 130.

As described above, the comparative sheet conveying device 100A can obtain the restorative force of a sheet without the roller 206 that is provided to the related-art sheet conveying device 220, and can prevent the second sheet from being affected by the conveyance force. Accordingly, the comparative sheet conveying device 100A can reduce the number of components more than the related-art sheet conveying device 220.

However, in the comparative sheet conveying device 100A, an angle formed by the sheet attraction surface of the attraction belt 130 (i.e., the surface of the attraction belt 130 that contacts the uppermost sheet S1 with the attraction belt 130 located at a sheet contact position) and the upper surface of the sheet stack S when the driven roller 130B separates from the sheet stack S remains constant. As a result, the comparative sheet conveying device 100A cannot perform properly with different types of sheets and under varying environmental conditions.

Specifically, when a thick sheet with high rigidity and restorative force is attracted to the attraction belt 130 at a large angle of rotation, the restorative force becomes stronger than the attractive force, which is likely to result in release of the uppermost sheet S1 from the attraction belt 130 before the subsequent conveyance.

By contrast, when a thin sheet with low rigidity is attracted to the attraction belt 130 at a small angle of rotation, the attractive force of the second sheet becomes strong than the restorative force thereof, which makes it difficult for the second sheet to separate from the uppermost sheet S1.

Further, the electrostatic attractive force between the uppermost sheet S1 and the attraction belt 130 decreases with humidity. Therefore, if the angle of rotation of the attraction belt 130 is large, the restorative force of the uppermost sheet S1 becomes stronger than the attractive force thereof, which makes it likely that the uppermost sheet S1 separates from the attraction belt 130.

Conversely, the electrostatic attractive force between the uppermost sheet S1 and the attraction belt 130 increases in low humidity environment. Therefore, if the angle of rotation of the attraction belt 130 is small, the attractive force of the second sheet becomes stronger than the restorative force thereof, which makes it difficult for the second sheet to separate from the uppermost sheet S1.

Accordingly, the different types of sheets and various environmental conditions can vary an optimal angle of rotation for sheet separation.

As described above, the sheet feeding device 90 according to this embodiment of the present invention includes the sheet feeding unit 30 and the contact and separation drive unit 70. The sheet feeding unit 30 serves as a sheet feeder to attract then feed and convey a sheet that faces the attraction belt 31 disposed facing the upper surface of the sheet stack S accommodated in the sheet cassette 15. The contact and separation drive unit 70 is composed of the wire 71, the wire collar 72, and the wire drive unit 73 to swing the sheet feeding unit 30 to contact and separate from the attraction belt 31 with respect to the sheet stack S. The sheet feeding unit 30 includes the belt unit 40 that includes the attraction belt 31, the drive roller 32 that serves as a first tension roller to keep the attraction belt 31 taut, and the driven roller 33 that serves as a second tension roller and is disposed upstream from the drive roller 32 in the sheet conveyance direction to keep the attraction belt 31 taut together with the drive roller 31, and the side plate 35 to rotatably support the belt unit 40 that pivots about the drive roller 32. The side plate 35 is pivotably mounted on the rotary shaft 36 that is a fulcrum of the sheet feeding unit 30, and the rotary shaft 36 is disposed upstream from the driven roller 33 in the sheet conveyance direction. The sheet feeding device 90 further includes the swing range adjusting unit 60 that serves as a swing range adjuster to change or adjust the range of swing of the belt unit 40 from the state in which the attraction belt 31 is held in contact with the uppermost sheet S1 of the sheet stack S to the state in which the attraction belt 31 is separated from the sheet stack S by the contact and separation drive unit 70.

With this configuration, the copier 10 according to the present invention can separate sheets at an optimal rotation angle according to given conditions such as environmental conditions and sheet types, thereby preferably separating each sheet from the sheet stack S.

Specifically, when a sheet having rigidity higher than a low-rigidity sheet that serves as a sheet having a first rigidity is conveyed, the range of rotation of the belt unit 40 for the sheet is changed to be smaller than the range of rotation of the belt unit 40 when the sheet having the first rigidity is conveyed. When the rigidity of the sheet is low, the restorative force thereof is also weak. Therefore, the range of rotation of the belt unit 40 is made large to obtain the sufficient restorative force of the sheet and therefore secure the appropriate separation ability. By contrast, when the rigidity of the sheet is high, the restorative force thereof is strong. Therefore, the range of rotation of the belt unit 40 is made small to form a small angle of rotation. This configuration can prevent the uppermost sheet S1 from separating from the attraction belt 31 due to the restorative force of the sheet, thereby preventing the sheet conveyance failure.

When the humidity detected by the thermohygrometer 83 that serves as a humidity detector is higher than the first humidity (e.g., low humidity), the range of rotation of the belt unit 40 at the humidity detected by the thermohygrometer 83 can be changed to be smaller than the range of rotation of the belt unit 40 at the first humidity. Under the low-humidity condition, the attractive force to the attraction belt 31 becomes stronger and multiple sheets can be attracted to the attraction belt 31 easily. Therefore, the range of rotation of the belt unit 40 is set to be longer to obtain the restorative force of the sheet sufficiently so as to secure the separation ability. By contrast, under the high-humidity condition, the attractive force to the attraction belt 31 becomes weaker. In this case, the range of rotation of the belt unit 40 is set to be shorter so that the restorative force of the sheet does not become greater than the attractive force for the uppermost sheet to the attraction belt 31. This configuration can prevent the uppermost sheet S1 from separating from the attraction belt 31, thereby preventing the sheet conveyance failure.

Further, the swing range adjusting unit 60 includes the adjuster drive unit 68, the pinion gear 64 that serves as a drive gear to which the drive force is transmitted from the adjuster drive unit 68, and the rack 63 that is meshed with the pinion gear 64 and attached to the shaft 33*a* of the driven roller 33. With this configuration, the drive force of rotation of the adjuster drive unit 68 can be converted to a force to shift the driven roller 33 along the slots 37, and the range of movement of the driven roller 33 along the slots 37 can be easily controlled based on sheet types and/or environmental conditions.

Further, the second pulley 88 that serves as a drive transmission member to transmit the drive force to the pinion gear 64 is coaxially mounted with the pivot of the attraction belt 31. Therefore, the distance between the second pulley 66 and the pinion gear 64 does not vary even when the attraction belt 31 is rotated, thereby transmitting the drive force of the adjuster drive unit 68 to the pinion gear 64 reliably.

The drive force of the adjuster drive unit 68 with the pulley to the pinion gear 64 is transmitted via the driven timing belt 67, and therefore, even if the second pulley 66 is relatively spaced away from the pinion gear 64, the drive force can be transmitted to the pinion gear 64 reliably, and the flexibility of design can be enhanced, compared to a configuration in which a gear train is used to transmit the drive force to the pinion gear 64.

Further, the copier 10 that serves as an image forming apparatus incorporates the above-described sheet feeding device 90, thereby preventing the sheet conveyance failure.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet feeding device, comprising:

a sheet feeder to feed and convey a sheet from a sheet container toward an image forming device, the sheet feeder including:

a belt unit including an attraction belt disposed facing a sheet stack accommodated in the sheet container, a first tension roller to keep the attraction belt taut, and a second tension roller disposed upstream from the first tension roller in a sheet conveyance direction to keep the attraction belt taut together with the first tension roller; and a side holder to rotatably support the belt unit that pivots about the first tension roller, the side holder pivotably mounted on a rotary shaft disposed upstream from the second tension roller of the belt unit in the sheet conveyance direction;

a contact and separation drive unit to swing the sheet feeder to make the attraction belt of the belt unit contact with and separate from the sheet stack; and a swing range adjuster including an adjuster drive unit, a drive gear to transmit a drive force from the drive unit, and a rack mounted on a shaft of the second tension roller for meshing with the drive gear, the swing range adjuster adjusting a range of swing of the belt unit with respect to the side holder between a sheet contact position at which the attraction belt contacts an uppermost sheet of the sheet stack and a sheet separation position at which the contact and separation drive unit causes the attraction belt with the uppermost sheet attracted thereto to separate from the sheet stack.

2. The sheet feeding device according to claim 1, wherein the swing range adjuster adjusts the range of swing of the belt unit according to at least one of a sheet type and an environmental condition.

3. The sheet feeding device according to claim 2, wherein the swing range adjuster adjusts the range of swing of the belt unit in conveyance of a sheet having a higher rigidity than a reference sheet to be smaller than the range of swing of the belt unit in conveyance of the reference sheet.

4. The sheet feeding device according to claim 2, wherein the swing range adjuster adjusts the range of swing of the belt unit at a humidity detected by a humidity detector being higher than a reference humidity to be smaller than the range of swing of the belt unit at the reference humidity.

5. The sheet feeding device according to claim 1, wherein components constituting the swing range adjuster other than the adjuster drive unit are disposed outside the side holder of the sheet feeding unit.

6. The sheet feeding device according to claim 1, wherein the swing range adjuster further comprises a drive transmission member disposed coaxially with a pivot of the sheet feeder to transmit a drive force to the drive gear.

7. The sheet feeding device according to claim 6, wherein the swing range adjuster further comprises a timing belt by which the drive force is transmitted from the drive transmission member to the drive gear.

8. An image forming apparatus, comprising:

an image forming device to form an image on a sheet; and the sheet feeding device according to claim 1.

9. An image forming apparatus, comprising:

the sheet feeding device according to claim 1;

a control unit operatively connected to the adjuster drive unit;

an operation input unit operatively connected to the control unit to accept inputted information on material and thickness of sheets accommodated in the sheet feeding container; and a humidity detector operatively connected to the control unit.

* * * * *